US005575229A

United States Patent [19]

Blackmer

[11] Patent Number: 5,575,229

[45] Date of Patent: Nov. 19, 1996

[54] CONTROL TACKLE APPARATUS FOR A SAILBOARD RIG OUTHAUL

[76] Inventor: Richard Blackmer, 109 Oakwood Dr., Scotia, N.Y. 12302

[21] Appl. No.: 342,599

[22] Filed: Nov. 21, 1994

[51] Int. Cl.[6] ..... B63B 35/00

[52] U.S. Cl. ..... 114/39.2; 114/109

[58] Field of Search ..... 114/39.1, 39.2, 114/89, 90, 97, 98, 102, 103, 104, 105, 106, 107, 108, 109

[56] References Cited

U.S. PATENT DOCUMENTS

| | | | |
|---|---|---|---|
| 4,530,299 | 7/1985 | Ross | 114/97 |
| 4,646,670 | 3/1987 | Jamieson | 114/98 |
| 5,095,838 | 3/1992 | Smith | 114/97 |

*Primary Examiner*—Stephen Avila
*Attorney, Agent, or Firm*—William C. Crutcher

[57] ABSTRACT

Tackle is provided to enable control of sail outhaul with one hand, while holding a windsurfing sail rig with the other. To avoid the use of jam cleats, pulleys and bungies, 3:1 ring cinches are used. A 3:1 ring cinch assembly is attached to right and left booms of the rig's wishbone boom. These are then attached to the ends of a clew line, which is part of 2:1 tackle from the boomtail to the outhaul grommet at the clew of the sail. The cinch line has four parts: (1) an anchor-part for a ring and a finder tab, (2) a pull-part for increasing sail outhaul, (3) a release-part for decreasing sail outhaul and (4) a cinch-part for pinching two cinch rings against the release-part while sharing the outhaul load with the pull and release parts. Through rigging geometry, the ring cinch pinch provides a self-energizing lock on the cinch line such that no slip can occur without a positive pull on the pull-part or release part. A tug line connects the ring cinches to a loop-cleat which, in turn, connects the 3:1 cinch assembly to the clew line.

7 Claims, 2 Drawing Sheets

CONTROL TACKLE APPARATUS FOR A SAILBOARD RIG OUTHAUL

BACKGROUND OF THE INVENTION

The invention relates generally to sailboards and more particularly to the tackle required to outhaul the sail during rigging and while sailing.

The airfoil shape of sails is set and controlled by outhaul and downhaul forces from the boom and mast. In modern sailboard rigs (sail, wishbone boom, flexible mast and universal pivot base), the primary control is downhaul force, ranging from 200 to 600 pounds. Depending on sail design, the maximum outhaul force (no wind) can range from 40 to 80 pounds and the control travel can exceed 3". Most rigs have two boomtail sheaves over which the clew line can be roved, either through the outhaul sail grommet or over sheaves in a hook block, for a 2:1 or 4:1 tackle ratio. Most rigs have the clew line anchored and cleated to the boomtail such that outhaul adjustments must be made on the beach or in the water. During the past few years, open-class racers have been running the clew line to jam cleats near their aft grip position on the booms and tying the slack ends (falls) together with elastic cords around the mast. Due to friction of small sheaves and grommet, the actual mechanical advantage of a 2:1 tackle is only 1.4:1 This means a pull range from 30 to 60 lbs, which is beyond the capability of many sailors, especially women, and tough on the hands of all.

It would be desirable to have a means to adjust the outhaul tension while sailing, especially during racing, with a control tackle apparatus which can be operated with one hand and which reduces the force to outhaul the sail by means of a mechanical advantage built into the control tackle.

Accordingly, one object of the invention is to provide an improved control tackle apparatus, which allows the sailor to more easily adjust the outhaul tension on the clew line in a sailboard rig.

Another object of the invention is to provide an improved control tackle apparatus for a sailboard rig which allows lengthening or shortening a tensioned line with one hand.

SUMMARY OF THE INVENTION

The invention comprises an improved outhaul control for a sailboard rig of the type which is attached to a sailboard with a universal connection, the rig comprising a mast, boom and sail, and control tackle apparatus comprising at least one ring cinch assembly, preferably one on either side of the sail, for pulling forward on the extension of the clew line from outhaul tackle at the tail of the wishbone boom.

The ring cinch assembly has an anchor ring and top and bottom cinch rings, means for anchoring the anchor ring to the boom, means for attaching the top and bottom cinch rings together and to the clew line, and a cinch line attached to the anchor ring, the cinch line having a pull-part portion extending from the anchor ring and passing between the top and bottom cinch rings, a release-part portion passing around the top cinch ring and extending back to the anchor ring, and a cinch-part portion passing around the anchor ring and extending back to the cinch rings, the cinch-part portion being secured to the top and bottom cinch rings by a loop passing around both said top and bottom cinch rings, whereby tension on the clew line may be increased by pulling on the pull-part portion and cinched between the top and bottom cinch rings when the pull-part portion is released, and whereby the tension on the clew line may be reduced by pulling on the release-part portion.

In its preferred embodiment the invention utilizes two sets of 3:1 ring cinch assemblies, one for each boom, each having a cinch line with an anchor part attached by means of a clove hitch to the boom and immediately to an anchor ring by means of clove or snug hitch, the pull-part of said cinch line then roving through a hole in one end of a finder tab, forming an overhand knot to retain said tab, forming a grip knot, forming a stop knot, roving between cinch ring and up through the top cinch ring, the release-part of said cinch line then roving down through the anchor ring, the cinch-part of said cinch line then ending with a left hand bowline loop around both cinch rings and the release-part so as to pinch and lock the release-part between cinch rings in a self-energizing manner, a loop-cleat line holding said cinch rings by means of a buntline hitch and attaching at its terminal end to a loop-cleat by means of a buntline hitch, a clew line, an end of the clew line from the boomtail tackle jamming into said loop-cleat and being secured by a half hitch or slipped half hitch around the loop-cleat and, finally, comprising the other end of the clew line jamming the loop-cleat of the cinch assembly on the opposite boom.

DRAWING

The subject matter will be more clearly understood by reference to the following drawing, in which.

DESCRIPTION OF THE PREFERRED EMBODIMENT

Figure 1:
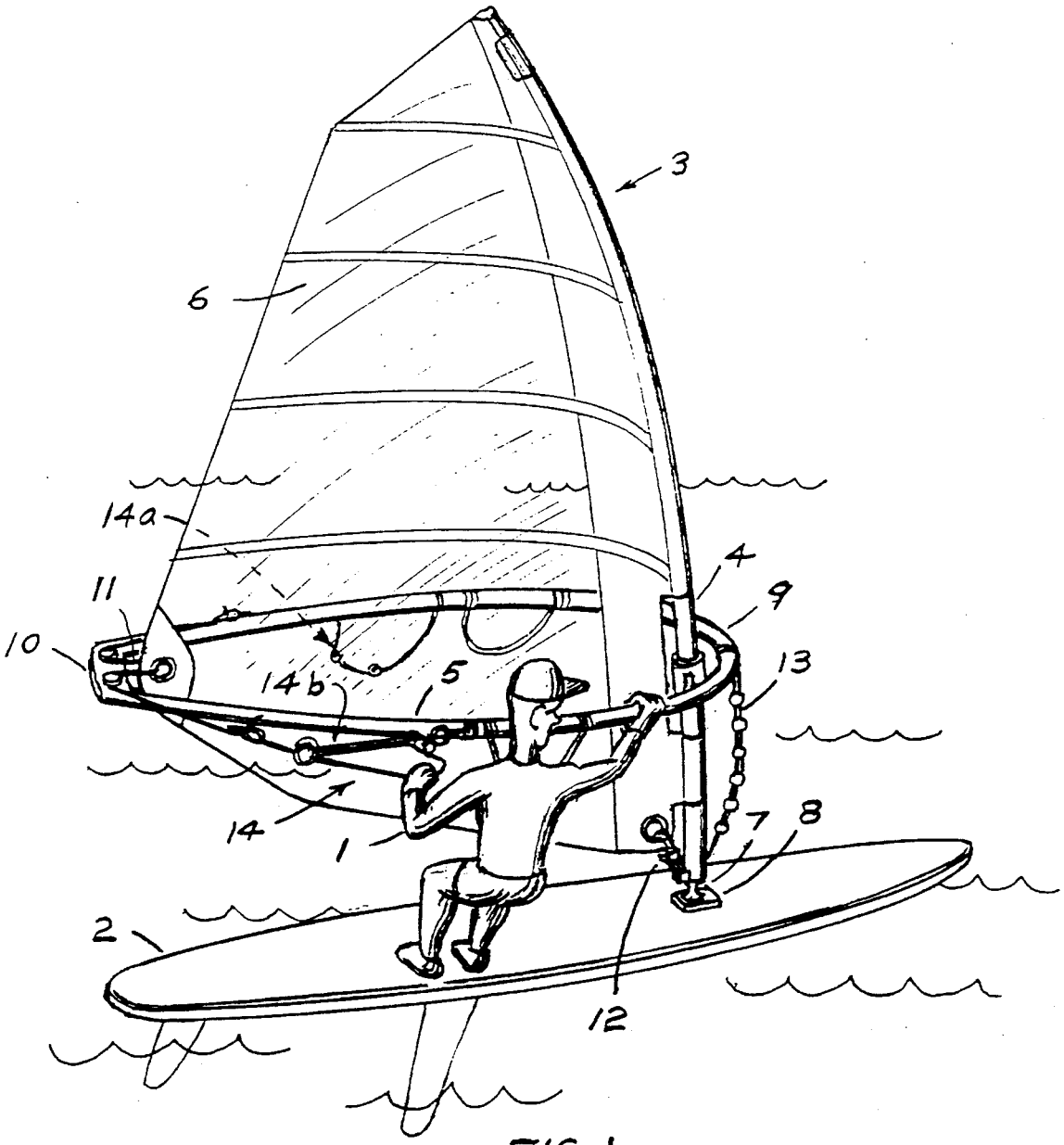
FIG. 1 is a perspective view of a sailboard with the sailor holding the boom of the sail rig with one hand, while pulling on the pull-part of the cinch line with his other hand, illustrating application of the invention to outhaul control while sailboarding.

Referring now to FIG. 1 of the drawing, illustrating outhaul control while sailboarding with the first embodiment of the invention, a sailor 1 is standing on a sailboard 2 of a conventional and well-known type with sail rig 3 in sailing position preparatory to increasing the outhaul to take up slack in the sail leach, after increasing downhaul, and/or flattening the sail for an upwind tack. The rig 3 collectively comprises a mast 4, a wishbone boom 5 connected to an intermediate location on mast 4 and a sail 6. Rig 3 is connectable to the sailboard 2 through the mast by means of a universal joint 7 which may be attached to mast step 8 on sailboard 2 in a known manner. The boom 5 is rigidly secured to the mast 4 by clamping a boomhead 9 to the mast and is bifurcated to terminate in a boom tail 10. The sail 6 is rigged and made taut between the boom and the mast by means of an outhaul 11 secured between the clew of the sail and the boom tail 10, and downhaul tackle 12 secured between the tack of the sail and the end of the mast adjacent to the universal joint 7. The conventional means of hoisting rig 3 would include an uphaul 13, which is also part of rig 3, consisting of a braided or knotted sheet or halyard attached by one end to boomhead 9 and graspable from there to the other end by sailor 1. The foregoing elements comprise a conventional sailboard and rig and form no part of the present invention.

In accordance with the present invention, a control tackle apparatus shown generally as 14 includes an extended clew line 11, a ring cinch assembly 14*a* for the left boom and a mirrored ring cinch assembly 14*b* for the right boom.

The control tackle 14 of FIG. 1 is, firstly, an aid for initial outhauling of sail during rigging and, secondly, a control for adjusting outhaul while sailing. The aerodynamic shape of a sail is adjusted by downhaul and outhaul tension. Downhaul control will generally require concurrent outhaul control, while outhaul control can be used alone with a fixed downhaul. Most recreational sailors are likely to use the control tackle only for rigging. Whereas, most competition sailors will use the tackle for both rigging and sailing control. The competition sailor will start most races on an upwind tack with the clew of the sail pulled tight against the boomtail for maximum outhaul which flattens the sail and provides maximum pumping efficiency. Upon rounding the upwind (weather) mark, in preparation for a reaching tack, the sailor will release outhaul tension to obtain deeper draft in his sail. He would then increase outhaul tension in preparation for an upwind tack.

Figure 2:
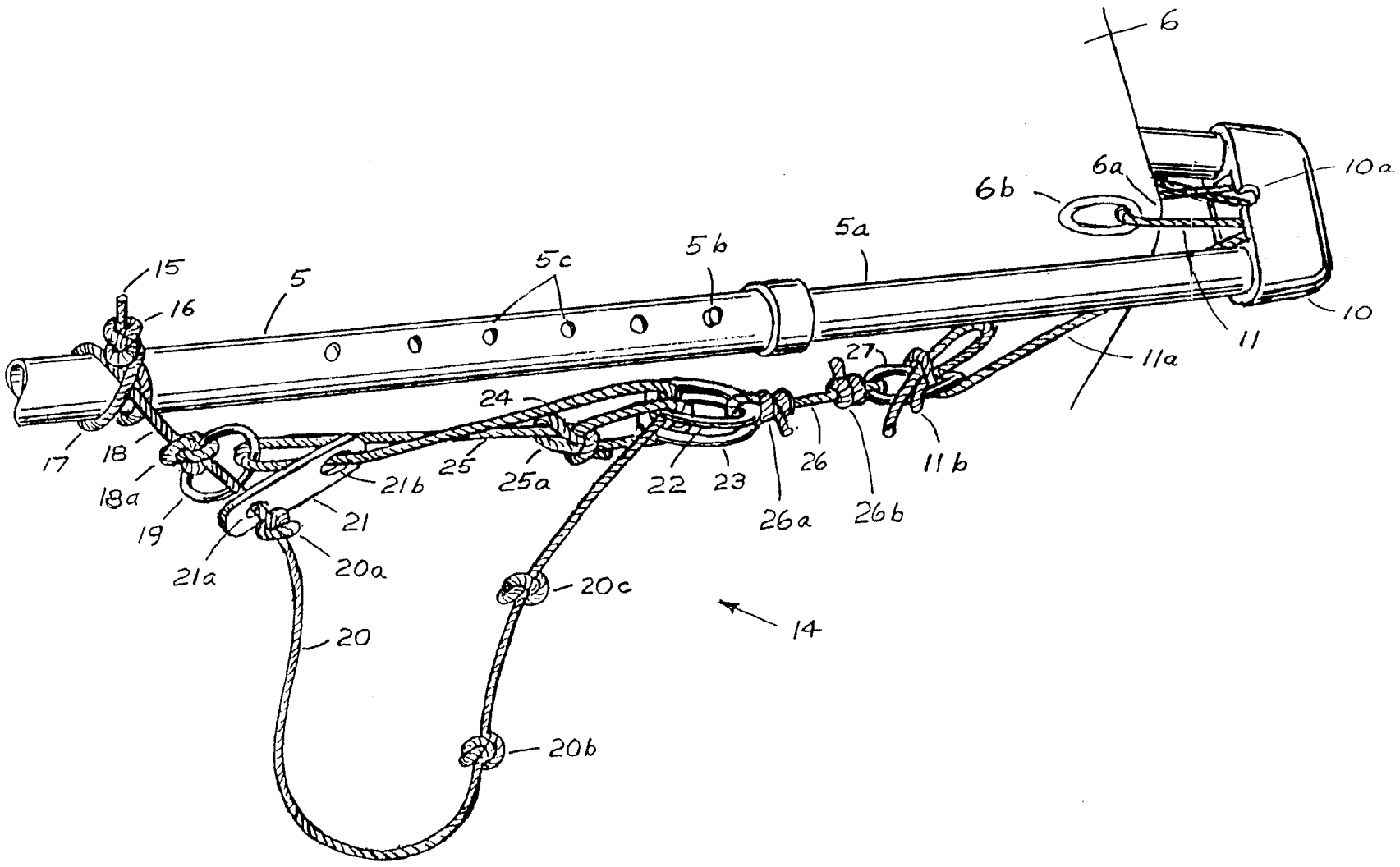
FIG. 2 is a perspective view of the left boom and boomtail of a sail rig, illustrating the left ring cinch assembly of the control tackle apparatus.

Reference to FIG. 2 of the drawing shows details of the outhaul control tackle left-hand assembly with the left-hand ring cinch assembly 14*a* of FIG. 1. The orientation of FIG. 2 is the reverse of that shown in FIG. 1 and locates the boom tail 10 or aft end of the rig on the right hand side of the drawing. Elements which are the same as previously described in connection with FIG. 1 are designated with the same reference numerals. The right-side cinch assembly 14*b*, hidden from view by the sail 6 in FIG. 2, is a mirror image of the left-side assembly.

Referring now to FIG. 2, the outhaul control tackle consists of an extended clew line 11 and two ring cinch assemblies. The left-side ring cinch assembly shown generally as 14*a* includes cinch line 15, the anchor-part 18 of cinch line 15 providing a means for attaching the 3:1 ring cinch assembly to boom 5 by making clove hitch 17 stopped by figure eight knot 16, and making snug hitch 18*a* on anchor ring 19. The remainder of the cinch line 15 is a functioning part of the ring cinch assembly and includes a pull-part 20 roving through hole 21*a* in finder tab 21, an overhand knot 20*a* to retain finder tab 21 close to anchor ring 19, a three ply grip knot 20*b*, a three ply stop knot 20*c*, roving between cinch rings 22 & 23, roving up through top cinch ring 22 and turning forward towards anchor ring 19. Cinch line 15 continues as a release-part 24 roving through hole 21*b* in finder tab 21, roving down through anchor ring 19 and turning aft towards the cinch rings 22,23.Finally the cinch line 15 terminates in a cinch-part 25, which is attached to both cinch rings 22,23 in a loop. The loop is made by roving down through both top cinch ring 22 and bottom cinch ring 23, turning forward around both cinch rings including release-part 24 and making left hand bowline knot 25*a* to complete a close loop around the cinch rings.

Means are provided for attaching the top and bottom cinch rings together and to the tensioned clew line. Preferably this comprises tug line 26 making buntline hitch 26*a* to cinch rings 22 & 23 and making buntline hitch 26*b* to a rigid metal loop-cleat 27. The fall 11*a* from clew line tackle 11 roves through loop-cleat 27, jamming in said loop-cleat and making a slipped half hitch 11*b* to secure the jamming. The clew line 11 turns around one of two sheaves in the boomtail 10, turns through sail outhaul grommet 6*b*, turns around second sheave and attaches to a similar loop-cleat (not shown) of the right-side cinch assembly.

As an alternate to the tug line 26 and the loop cleat 27, the clew fall 11*a* could be secured directly to the two cinch rings 22,23, at the location of the buntline hitch 26*a*, the major advantage of the loop cleat 27 being that it is simpler to apply the proper initial tension to the clew line 11 by pulling on the line 11 and then jamming it in the loop cleat.

Refer again to FIG. 2 for explanation of installation and operation procedures for the outhaul control apparatus. The boom extension 5*a* is positioned in the boom 5 by snap-button 5*b* in one of several snap-button holes 5*c*. The snap-button location is selected by the sailor to provide the maximum desired outhaul when the clew of the sail 6*a* is hard against the boomtail at 10*a*. The extended position of the ring cinch assembly is preselected by the stop knot 20*c*, which prevents the pull part 20 from slipping between cinch rings 22 and 23. The sailor locates the anchor-part clove hitch 17 on boom 5 such that the clew of the sail 6*a* will be at the midpoint of its control travel range when the ring cinch assemblies are at their mid-points. The latter mid-points are determined by pulling the grip knot 20*b* all the way forward of the anchor ring 19, with the pull-part 20 doubled and parallel to the boom. To increase outhaul tension on the clew line, the sailor reaches back on the boom 5, until he can feel finder tab 21 which segregates the pull-part 20 and the release-part 24 for identifying them by touch, since the pull part 20 has a knot 20*a*. He then follows the pull-part 20 of the cinch line back to the grip knot 20*b* (or the stop knot 20*c*, which can also serve as a grip knot in this case), and pulls until desired outhaul is achieved. The 3:1 tackle is so-called because it has a theoretical mechanical advantage of 3:1 (three to one). It has an actual mechanical advantage of about 2:1 due to friction and absence of using sheaves. No slippage will occur when the sailor releases the pull-part 20, as the pinch friction force of the cinch rings 22 & 23 on release-part 24 will always exceed the release-part's share of load. In fact, the release force may be of same magnitude as the pull force. To decrease outhaul, the sailor reaches back on the boom 5, until he can feel finder tab 21. The size and geometry of the finder tab is such that the control can be operated while wearing thermal gloves. The sailor then, using the tab, works his fingers between release-part 24 and cinch-part 25, follows back on the release-part 24 and pulls release part 24 away from the boom, and or grips and pulls the release part forward, ie. toward the left in FIG. 2. This causes it to slightly separate cinch rings 22,23 and slip between the cinch rings 22 and 23, allowing the cinch assembly to extend until the desired outhaul is achieved. Again, the self-energizing locking action of the cinch rings avoids need for any clearing action when the operator releases the release part 24.

A 3:1 ring cinch assembly with a 14" working range will provide 7" of outhaul range with 2:1 outhaul tackle, providing that the opposite cinch has been pulled to its mid-point before tacking or jibing.

While the invention has been described in its preferred embodiment, using two ring cinch assemblies, it is possible to employ only one ring cinch assembly. While this requires the sailor to be on the side of the sail where the ring cinch assembly is attached to the boom when making the adjustment to outhaul tension, it may be easier to operate when adjustments are being made less frequently and not being made under racing conditions.

On some applications it may be desirable to have a greater mechanical advantage in the ring cinch assembly in order to exert a greater tension using less force, while sacrificing the extent of movement. In this case a 5:1 ring cinch assembly is constructed much as described above. However, instead of attaching cinch part 25 to cinch rings 22, 23 immediately in a loop, cinch part 25 makes another pass between cinch rings by roving through cinch rings 22,23, back to and roving through anchor ring 19 again, and then back to cinch rings 22,23 for attachment thereto in a loop as previously described. While the tackle ratio is theoretically increased from 3:1 to 5:1, there is considerably more friction and the actual mechanical advantage is much less than 5:1.

While there is described what is considered to be the preferred embodiment of the invention and a modification thereof, it is intended to encompass in the appended claims all such modifications as fall within the true spirit and scope of the invention.

I claim:

1. An improved control tackle apparatus for a sailboard rig having a boom, a mast and a sail with a clew line under tension, said control tackle apparatus comprising:

at least one ring cinch assembly having an anchor ring and top and bottom cinch rings, means for anchoring said anchor ring to said boom, means for attaching said top and bottom cinch rings together and to said clew line, said ring cinch assembly further comprising a cinch line attached to said anchor ring, said cinch line having a pull-part portion extending from said anchor ring and passing between said top and bottom cinch rings, a release-part portion passing around said top cinch ring and extending back to said anchor ring, and a cinch-part portion passing around said anchor ring and extending back to said cinch rings, said cinch-part portion being secured to said top and bottom cinch rings by a loop passing around both said top and bottom cinch rings, whereby tension on said clew line may be increased by pulling on said pull-part portion and cinched between said top and bottom cinch rings when the pull-part portion is released, and whereby the tension on said clew line may be reduced by pulling on said release-part portion.

2. The combination according to claim 1, comprising a pair of said ring cinch assemblies, the anchor ring of one of said pair being attached to the boom on one side of the sail, and the anchor ring on the other one of said pair being attached to the boom on the other side of the sail.

3. The combination according to claim 1, wherein said cinch line pull portion includes a stop knot, said stop knot being located in said pull portion so as to establish an extended position when it is adjacent said cinch rings to stop further extension of said ring cinch assembly, and wherein said first grip knot is located substantially midway between said anchor ring and said cinch rings when said ring cinch assembly is in said extended position.

4. The combination according to claim 3, wherein said cinch line pull portion includes a grip knot, said grip knot being located in said pull-part portion substantially midway between said anchor ring and said cinch rings when the ring cinch assembly is in said extended position.

5. The combination according to claim 1, and further including a finder tab adapted to cooperate with the pull-part portion and the release-part portion so as to segregate and identify the pull-part portion and the release-part portion of the cinch line for locating by feel.

6. An improved outhaul control tackle apparatus for a sailboard rig of the type which is attachable to a sailboard with a universal connection, said rig comprising a mast, a boom having a boomhead with an aft harness line attachment, an uphaul and a sail having an extended clew line, said tackle apparatus comprising:

two 3:1 ring cinch assemblies, one for the left boom and the other for the right boom of said rig, attachment means to anchor the cinch assemblies to the booms immediately aft of the aft harness line attachment, pull and release means to increase or decrease outhaul tension, cleating means to attach the cinch assemblies to the falls of the extended clew line, comprising a loop-cleat attached to the cinch rings, positioning means for setting the ring cinch to mid-point of its working travel range, stopping means to prevent over-travel of the cinch assemblies and to insure slack in the pull-part of the cinch line,and loop means for supporting cinch rings, while providing a self-energizing friction lock on the cinch line.

7. The combination according to claim 6, wherein the 3:1 ring cinch assemblies are replaced with 5:1 assemblies for greater mechanical advantage.

* * * * *